United States Patent [19]

King

[11] Patent Number: 4,500,148

[45] Date of Patent: Feb. 19, 1985

[54] DISPLAY AND STORAGE UNIT

[75] Inventor: Homer F. King, Elmhurst, Ill.

[73] Assignee: H. King & Associates, Ltd., Elmhurst, Ill.

[21] Appl. No.: 462,580

[22] Filed: Jan. 31, 1983

[51] Int. Cl.[3] ..... A47B 51/00

[52] U.S. Cl. ..... 312/312; 312/122; 312/127; 312/131; 312/132

[58] Field of Search ..... 211/1.3; 312/119, 121, 312/122, 124, 126, 131, 132, 312, 127; 292/135

[56] References Cited

U.S. PATENT DOCUMENTS

| | | | |
|---|---|---|---|
| 831,828 | 9/1906 | Burrage | 108/96 |
| 1,425,259 | 8/1922 | Howe | 312/312 |
| 1,558,740 | 10/1925 | Muck | 292/175 |
| 2,011,522 | 8/1935 | Macklanberg | 292/175 |
| 2,657,068 | 1/1951 | Sweet | 292/175 |
| 2,944,540 | 7/1960 | Littell, Jr. | 312/312 |
| 3,893,740 | 7/1975 | England | 312/216 |

*Primary Examiner*—William E. Lyddane
*Assistant Examiner*—Joseph Falk
*Attorney, Agent, or Firm*—Neuman, Williams, Anderson & Olson

[57] ABSTRACT

A display and storage unit is provided for accommodating a plurality of articles in an attractive yet orderly fashion. The unit includes a housing having an upright interior chamber with an exposed open bottom positioned a substantial distance above a supporting surface. Disposed within the chamber are a plurality of carriers which are arranged in substantially face-to-face relation and are mounted for independent substantially vertical movement between various selected modes. Each carrier is adapted to accommodate a plurality of articles and segregate same into a predetermined number of groups, the latter being disposed in side-by-side relation. When in a first mode, the carrier is substantially concealed within the chamber and the accommodated articles are inaccessible. When in a second mode, the carrier projects downwardly a substantial amount through the open bottom of the housing whereby any depleted groups of accommodated articles can be manually replenished. Independently adjustable means is provided which coacts with the housing and each carrier for retaining the carrier in a selected mode.

8 Claims, 11 Drawing Figures

DISPLAY AND STORAGE UNIT

BACKGROUND OF THE INVENTION

In the merchandising of certain products or articles such as packaged tobacco products in supermarkets, restaurants, and the like, it is oftentimes desirable to have a variety of such articles attractively displayed and yet, at the same time, have the access and dispensing thereof controlled by the cashier or checkout clerk.

Heretofore, in dispensing such articles by personnel, one or more of the following problems were encountered: (a) the articles were displayed in a cabinet or display case disposed beneath or behind the checkout or cashier's counter and required the cashier or clerk to bend over or reach behind in an awkward and uncomfortable manner so as to open doors or closures to gain access to the sealed article; (b) the articles were arranged in racks or display structures which were unstable and unattractive; (c) the racks or display structures were not capable of being secured against unauthorized dispensing when the cashier or clerk was not present; (d) the racks or display structures were incapable of accommodating a large quantity or variety of articles; or (e) it was an awkward and sometimes frustrating manual manipulation to remove a single article from the rack or display structure.

SUMMARY OF THE INVENTION

Thus, it is an object of the invention to provide an improved display and storage unit which readily overcomes all of the aforenoted problems associated with equipment of this general type.

It is a further object to provide an improved display and storage unit which is capable of simultaneously accommodating and displaying efficiently and attractively a wide variety of articles.

It is a further object to provide an improved display and storage unit wherein reloading or replenishing the supply of articles can be accomplished in facile manner and without requiring disassembly of various parts or components of the unit.

Further and additional objects will appear from the description, accompanying drawings, and appended claims.

In accordance with one embodiment of the invention, an improved display and storage unit for articles such as packs of cigarettes or the like, is provided. The unit includes a housing having an interior chamber with an exposed open bottom positioned a substantial distance above a supporting surface. Disposed within the chamber are a plurality of carriers arranged in substantially face-to-face relation and each carrier is mounted for independent substantially vertical relative movement between selected modes. Each carrier is adapted to accommodate a plurality of articles and segregate same into a predetermined number of groups. An independently adjustable means is provided which coacts with the housing and each carrier to retain the latter in a selected mode. When the carrier is in a first mode, it is substantially concealed within the chamber and the articles accommodated thereby are inaccessible.

When the carrier is in a second mode, a substantial portion of the carrier projects downwardly through the housing open bottom whereby depleted groups of accommodated articles can be manually replenished. When the carrier is in a third mode, a limited predetermined portion of the carrier projects downwardly through the open bottom of the housing whereby a restricted number of the accommodated articles in each group are exposed and capable of being selectively removed from the carrier.

DESCRIPTION

For a more complete understanding of the invention, reference should be made to the drawings wherein.

Figure 3:
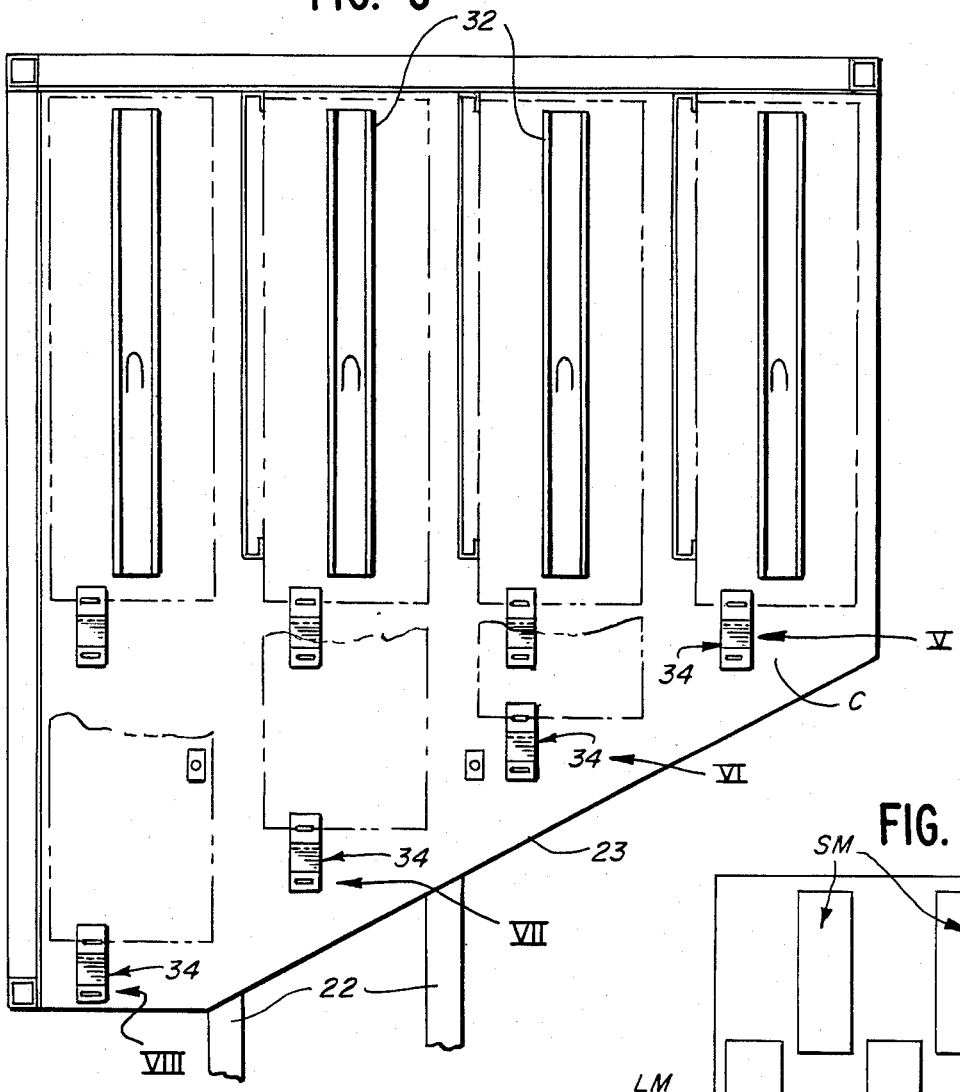
FIG. 3 is an enlarged fragmentary sectional view taken along line 3—3 of FIG. 1.
Figure 6:
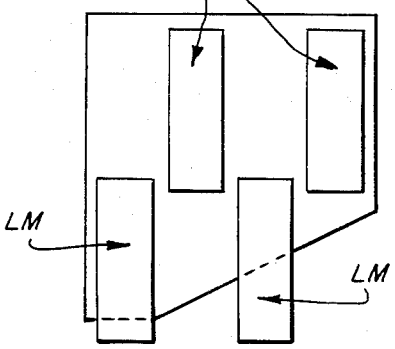
Figure 4:
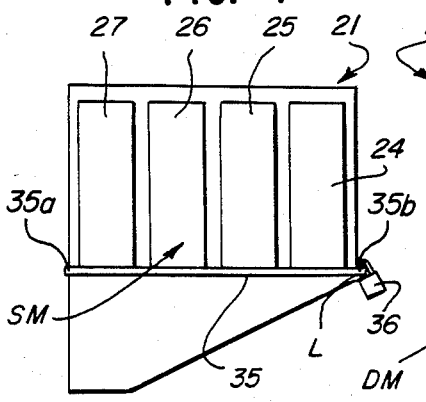
Figure 5:
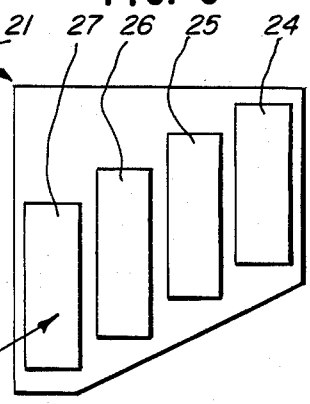
Figure 7:
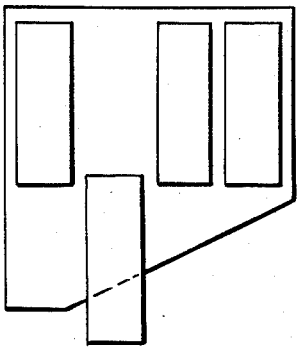

FIGS. 4–7 are schematic views similar to FIG. 3 but showing the carriers in the following modes: FIG. 4, all carriers in the first mode; FIG. 5, all but one of the carriers in the third mode; FIG. 6, two carriers in the second mode and remaining carriers in the third mode; FIG. 7, one carrier in the second mode and remaining carriers in the first mode.

Figure 8:
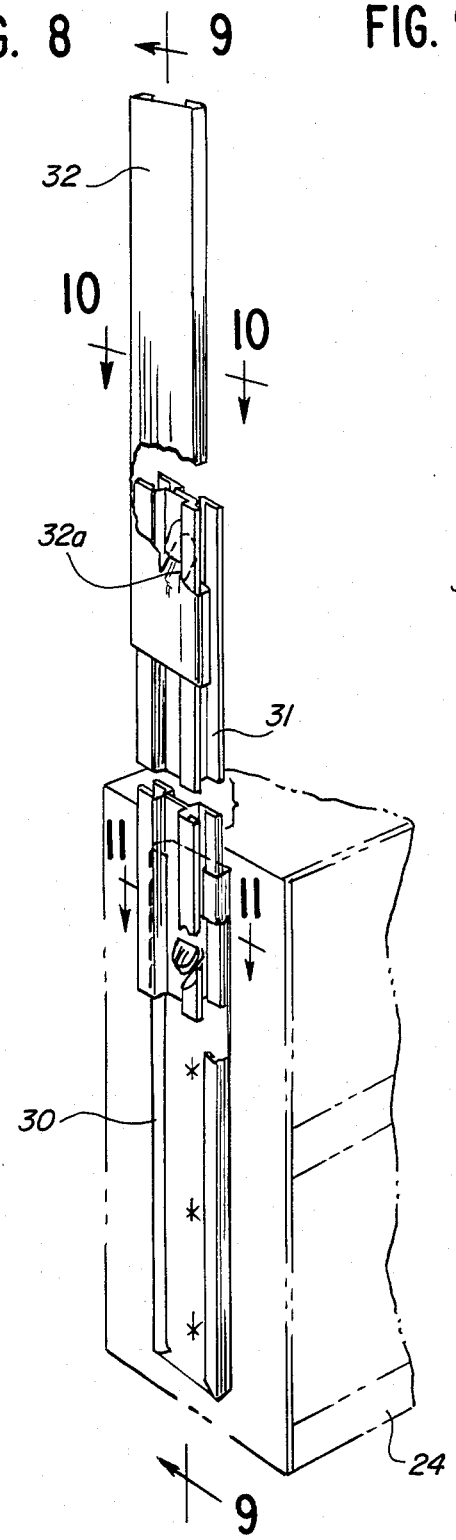

FIG. 8 is an enlarged fragmentary perspective view of a portion of the slide assembly for guiding the vertical movement of one carrier within the housing.

Figure 9:
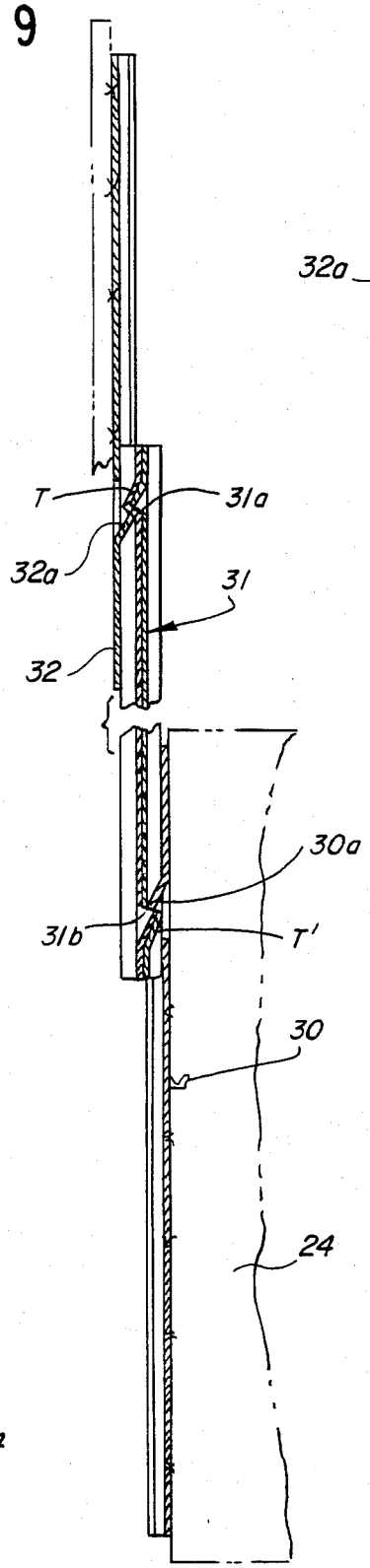

FIG. 9 is a fragmentary sectional view taken along line 9—9 of FIG. 8.

Figure 10:
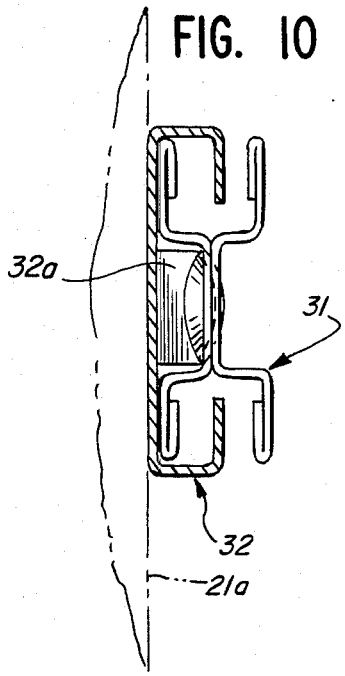
Figure 11:
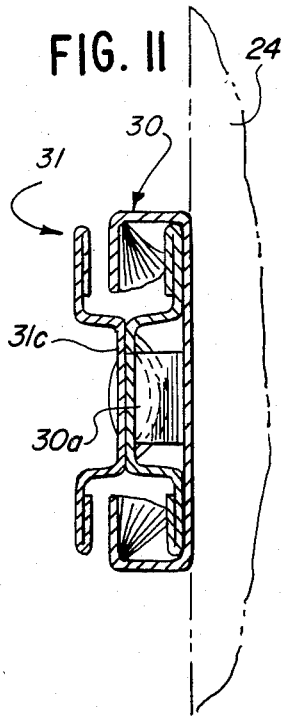

FIGS. 10 and 11 are enlarged fragmentary sectional views taken along lines 10—10 and 11—11, respectively, of FIG. 8.

Figure 1:
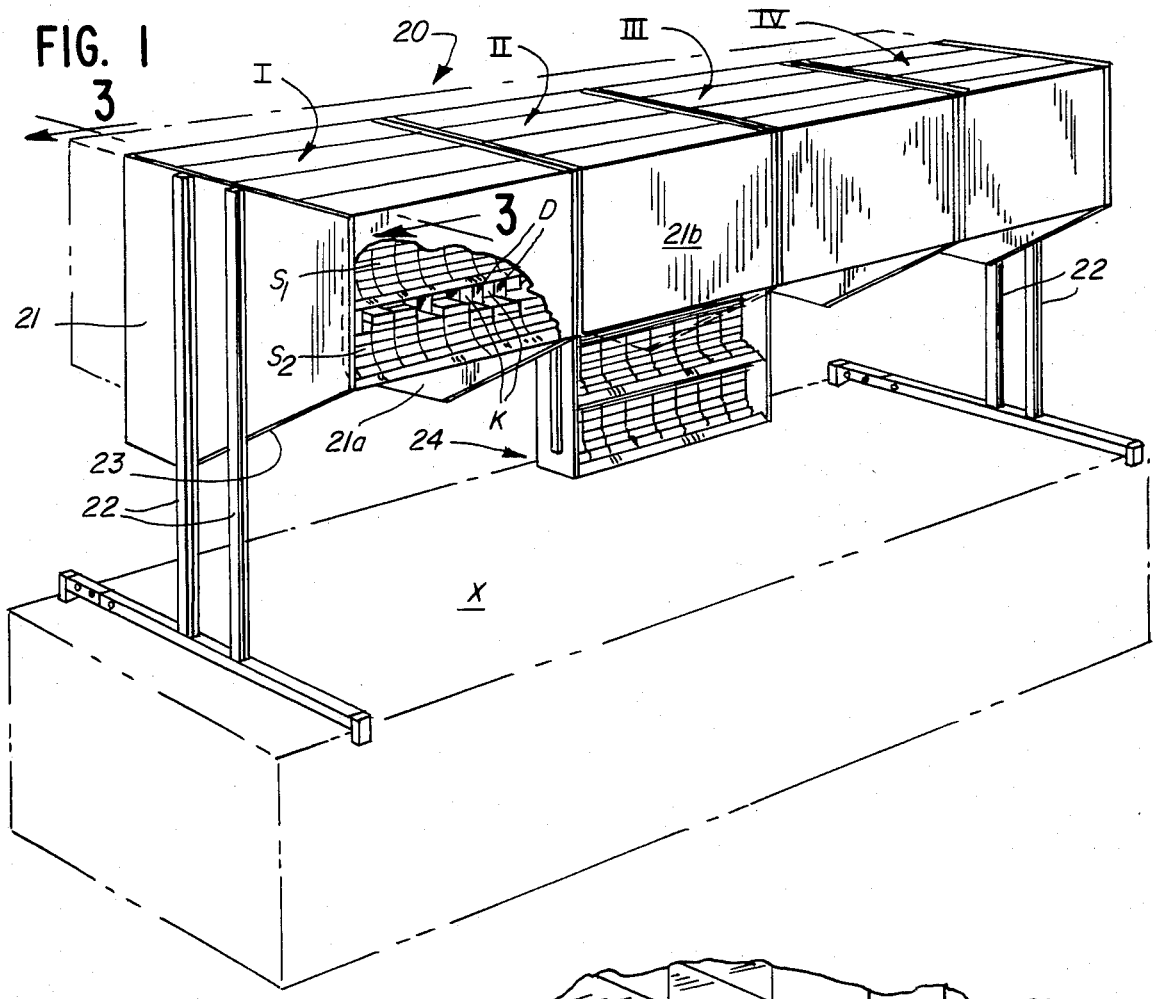
FIG. 1 is a perspective front view of a preferred embodiment of the improved display and storage unit with portions thereof removed so as to reveal certain of the carriers disposed in the first mode and one of the carriers disposed in the third mode.

Referring now to the drawings, and more particularly, to FIG. 1, a preferred embodiment of the improved display and storage unit 20 is shown which includes an elongated housing 21 positioned by suitable supports 22 at an elevated position with respect to a supporting surface X. The surface X may constitute a table top, counter top, or the like. The housing is provided with an upright interior chamber C having an open bottom 23. In the illustrated embodiment, housing 21 is formed of a plurality of like sections I, II, III, and IV arranged in side-by-side relation and secured to one another by suitable fasteners, not shown. Each housing section, as shown, is of like construction and has mounted within the interior chamber thereof a plurality of carriers 24, 25, 26, and 27. The number of sections comprising the housing and the number of carriers disposed within each housing section may vary, if desired, from that shown. The carriers are preferably of like construction and are arranged in face-to-face relation and are movable independently of one another between a storage (first) mode SM (FIG. 4); a display (third) mode DM (FIG. 5); and a loading (second) mode LM (FIG. 6 or 7), as will be described more fully hereinafter. Each carrier is of like construction and thus, only carrier 24 will be described in detail.

Carrier 24 includes a substantially rectangular frame 28 having elongated vertically extending channel-shaped guides 30 secured to the exterior of the sides **28*a* of the frame. Each guide 30 slidably engages a complemental vertically extending track 31 which, in turn, slidably engages a second channel-shaped guide 32. The second guides 32 are secured to the interior surfaces of the side walls 21*a* of the housing. The track 31 is provided with a pair of longitudinally spaced openings 31*a***, 31*b*. Opening 31*a* is provided with a tongue T which projects downwardly and outwardly from an upper perimetric segment of the opening. Opening 31*b*, on the other hand, is also provided with a tongue T′ which project upwardly and inwardly from a lower perimetric segment of the opening, see FIG. 9.

It will also be noted in FIG. 9 that guide 30 is provided with a downwardly and outwardly projecting nub 30*a* which is adapted to interlock with the tongue T′ formed adjacent the lower end of the track 31. Guide 32, on the other hand, is provided with an upwardly and inwardly extending nub 32*a* which is adapted to interlock with the tongue T formed adjacent the upper end of track 31. As seen in FIG. 9, the carrier is disposed in the loading mode LM—that is to say, the carrier is projecting downwardly from the housing open bottom 23 to the fullest extent and the nubs and tongues are in interlocking relation.

When the carrier is moved upwardly from the loading mode LM to the display mode DM or the storage mode SM, the track 31 moves upwardly simultaneously with guide 30. In order to retain the carrier in one of the selected modes, SM, DM, or LM, a spring biased bolt 33 (See FIG. 2) is mounted on the underside of each carrier adjacent each vertical side thereof. Each bolt has an inner end 33*a* which is offset downwardly and functions as a handle means for manually retracting the bolt. The opposite or outer end 33*b* of the bolt is adapted to protrude laterally from the side of the carrier frame 28 and is adapted to engage one of a group of brackets or ledges 34 which are secured to the side 21*a* of the housing. A first group V of brackets are disposed in a first horizontal plane which is disposed at the greatest elevation with respect to the supporting surface X. When the group V brackets are engaged by the bolt ends 33*b*, the corresponding carriers are disposed in the storage mode SM wherein the carrier and its contents are concealed within the housing interior and the contents cannot be removed from the carrier. It should be noted in the illustrated embodiment that as to carrier 24 there is only a group V bracket, thus, to gain access to the articles accommodated by the carrier 24, requires that the bolts 33 on the underside of the carrier be simultaneously retracted whereby the bolt ends 33*b* disengage the brackets and the carrier is lowered to its loading mode LM. When in the loading mode, the accommodated articles may be removed from the carrier or the supply of articles replenished. If desired, however, the front wall 21*b* of the housing could be slidable vertically or hinged at the top or at one side so that the accommodated articles in carrier 24 could be removed therefrom when the carrier is in the storage mode and the front wall is slid upwardly or hinged to an open position. As seen in FIG. 4, all of the carriers 24–27 may be secured in a storage mode and the front wall 21*b* secured in a closed position by an elongated lock bar 35 which slidably subtends the underside of all the carriers and has one end 35*a* of the bar supported by the back wall 21*c* of the housing and the opposite end 35*b* of the bar secured by a padlock 36 to a latch L or the like provided at the lower edge of the front wall of the housing, shown schematically in FIG. 4. Various other means from that shown may be utilized for securing the carriers in a storage mode.

The brackets 34 for each carrier are arranged so that as the carrier moves in a vertical plane the bracket will be aligned with the center recessed portion 31*c* of track 31 so as not to interfere with the vertical movement of the track. The extent to which the bracket protrudes from the housing side wall 21*a* is less than the extent to which the track center portion is recessed from the side wall. The bracket included in group VI is several inches below the brackets in group V so that when carrier 25 is in the display mode DM, the lower portion of carrier 25 will extend downwardly below the underside of carrier 24. The brackets in groups VII and VIII will be disposed beneath the group V brackets a progressively greater amount, so that when the carriers are in the display mode shown in FIG. 5, the lower portions of the carriers will be in a downwardly stepped exposed relation when viewed from the front of the unit.

Figure 2:
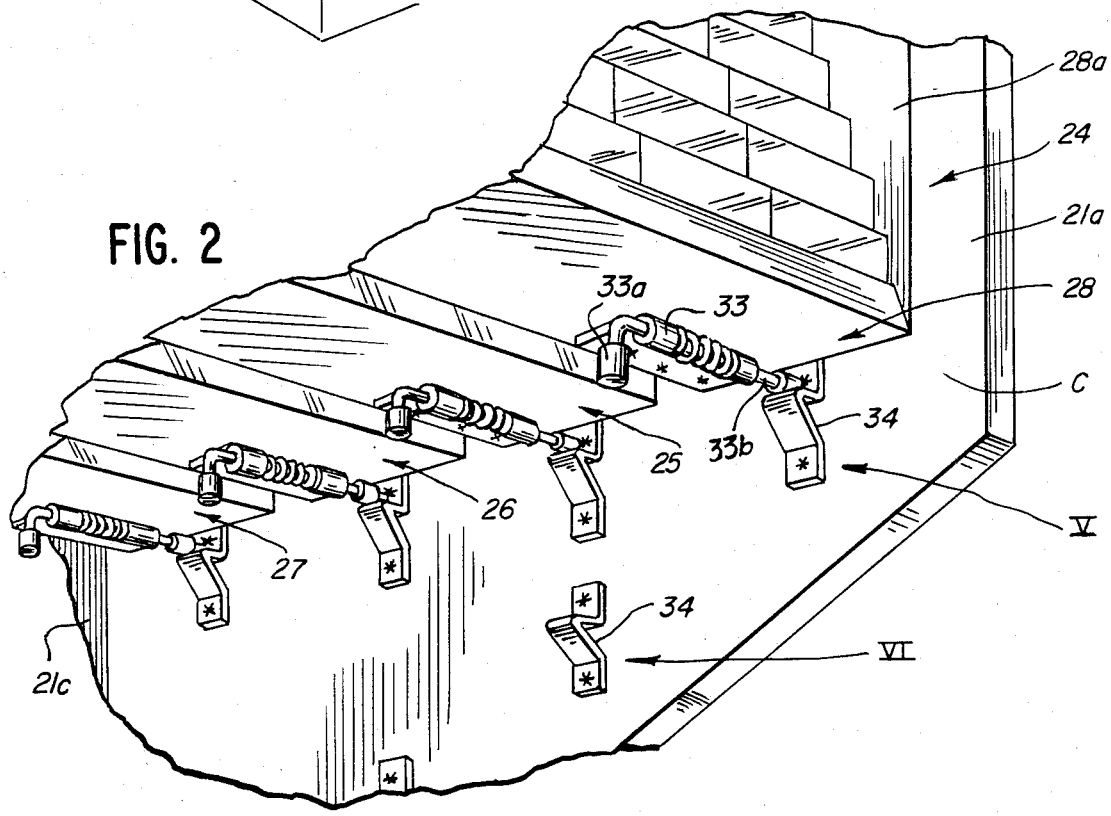
FIG. 2 is an enlarged fragmentary perspective view of the open bottom of the housing and showing the carriers disposed in the first mode within the housing.

As seen more clearly in FIGS. 1 and 2, each carrier has the center portion thereof, delineated by the frame 28, subdivided into a plurality of elongated, upright compartments K, see FIG. 1, by a plurality of laterally spaced, parallel, upright dividers D. The spacing between the dividers and the number of dividers utilized will depend upon the shape and size of the articles accommodated by the carrier. The dividers may also function as supports for removable shelves of the type disclosed in pending application Ser. No. 404,016 filed Aug. 2, 1982. When such type shelves are utilized, the lower articles disposed within a given compartment are cammed outwardly a small amount toward the front side of the carrier, thereby facilitating removal of the lowermost article from the stack of articles disposed within a given compartment. In lieu of the aforenoted removable shelves, the bottom surface of each compartment can be fixed and tilted upwardly a slight amount from the rear wall surface, not shown, toward the front of the carrier. In addition, the rear wall surface of the carrier for a short distance above the bottom surface can be cammed forward a slight amount by a wedge or the like, not shown, so that the lower three or four articles in a given compartment will be offset forwardly in a stepped relation with each other, see FIG. 2.

In certain instances, the compartments formed in a carrier may be divided into upper and lower sections $S_1$ and $S_2$, see FIG. 1. The relative length (height) of each section of a compartment of a carrier will be determined by the relative location of the shelf on the upright dividers.

Thus, it will be seen that an improved display and storage unit has been disclosed which is capable of readily accommodating a large number and variety of articles in a simple, compact, convenient, and attractive manner.

I claim:

1. A display and storage unit for articles arranged in a plurality of segregated groups, said unit comprising a housing having an interior chamber with an open bottom, said open bottom being exposed and positioned a substantial distance above a supporting surface; a plurality of carriers each accommodating a predetermined number of segregated article groups, said carriers being disposed in substantially face-to-face relation within said chamber, each carrier being mounted for independent movement between predetermined modes, when in a first mode, each carrier being substantially concealed within said chamber, when in a second mode, a substantial portion of the carrier projects downwardly through the housing open bottom whereby depleted groups of accommodated articles can be manually replenished, and when a predetermined number of said carriers are simultaneously in a third mode intermediate said first and second modes, the corresponding lower portions of said predetermined number of carriers are exposed and extend downwardly through said housing open bottom a predetermined amount so that said exposed lower portions are arranged in a downwardly stepped relation when viewed from the front side of the unit; and independently adjustable means co-acting with the housing and each carrier for retaining each of said carriers in a selected mode.

2. The display and storage unit of claim 1 wherein said carriers and portions of the chamber forming walls of said housing are provided with complemental guide means for limiting the carriers to predetermined parallel paths of movement.

3. The display and storage unit of claim 1 wherein said housing is provided with security means for locking said carriers in said first mode.

4. The display and storage unit of claim 1 wherein said carriers are arranged in a plurality of rows, said rows being disposed in substantially face-to-face relation and each row includes a predetermined number of carriers arranged in side-by-side, substantially coplanar relation.

5. The display and storage unit of claim 4 wherein each carrier in a row is selectively movable independently of the other carriers in the row to any of said modes.

6. The display and storage unit of claim 1, wherein said housing includes a plurality of supporting legs.

7. The display and storage unit of claim 1, wherein said adjustable means includes for each carrier in said chamber of said housing at least one catching bracket mounted on said housing, at least one bolt mounted on said carrier, at least one first guide member mounted on said housing adjacent said carrier, at least one second guide member mounted on said carrier, and at least one track member in sliding engagement with said first and second guide members, said bracket co-acting with said bolt and said first guide member, second guide member and tract member co-acting together to retain said carrier in a selected mode.

8. The display and storage unit of claim 7, wherein said first and second guide members and said track member are flat, elongate members.

* * * * *